US012612851B2

(12) United States Patent
Chica Carrillo et al.

(10) Patent No.: US 12,612,851 B2
(45) Date of Patent: Apr. 28, 2026

(54) SYSTEMS AND METHODS FOR DETERMINING DEPTH-DEPENDENT DRILLING PARAMETER LIMITS

(71) Applicant: Schlumberger Technology Corporation, Sugar Land, TX (US)

(72) Inventors: Pablo Chica Carrillo, Villahermosa (MX); Isauro Abinadi Valdez, Villahermosa (MX); Pamela Lopez Hernandez, Houston, TX (US); Valerian Guillot, Montpellier (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/207,448

(22) Filed: May 14, 2025

(65) Prior Publication Data

US 2025/0354472 A1 Nov. 20, 2025

Related U.S. Application Data

(60) Provisional application No. 63/648,226, filed on May 16, 2024.

(51) Int. Cl.

| | |
|---|---|
| ***E21B 44/00*** | (2006.01) |
| ***E21B 45/00*** | (2006.01) |
| ***E21B 49/00*** | (2006.01) |

(52) U.S. Cl.

CPC ..... *E21B 44/00* (2013.01); *E21B 45/00* (2013.01); *E21B 49/00* (2013.01); *E21B 2200/20* (2020.05)

(58) Field of Classification Search

CPC ..... E21B 44/00; E21B 45/00; E21B 49/00; E21B 49/003; E21B 2200/20; E21B 44/02; E21B 47/06

See application file for complete search history.

(56) References Cited

U.S. PATENT DOCUMENTS

| | | | | |
|---|---|---|---|---|
| 9,057,245 | B2 * | 6/2015 | Wassell | E21B 44/04 |
| 10,487,640 | B2 * | 11/2019 | Aniket | E21B 7/04 |
| 2016/0054729 | A1 * | 2/2016 | Payette | E21B 44/04 700/275 |
| 2017/0328181 | A1 * | 11/2017 | Kristjansson | G06Q 10/06 |
| 2020/0040719 | A1 * | 2/2020 | Maniar | E21B 41/00 |
| 2021/0108500 | A1 * | 4/2021 | Venugopal | G06N 3/0499 |
| 2021/0372262 | A1 * | 12/2021 | Machocki | E21B 43/30 |
| 2022/0397027 | A1 * | 12/2022 | Guillot | E21B 45/00 |
| 2023/0125398 | A1 * | 4/2023 | Abdelaal | E21B 45/00 175/24 |

(Continued)

*Primary Examiner* — Daniel P Stephenson

(74) *Attorney, Agent, or Firm* — Kyle R. Miiller

(57) ABSTRACT

A parameter roadmap system receiving reference wellbore data including drilling parameter data for one or more reference wellbores and selects a segmentation parameter set and associated segmentation parameter data from the reference wellbore data. Based on the segmentation parameter data, the parameter roadmap system segments the reference wellbore data into a plurality of depth segments using a statistical segmentation model. The parameter roadmap system identifies a segment threshold for each drilling parameter of the reference wellbore data at each of the plurality of depth segments to generate a drilling parameter roadmap and provides the roadmap for forming a target wellbore.

20 Claims, 8 Drawing Sheets

(56) References Cited

U.S. PATENT DOCUMENTS

| | | | | |
|---|---|---|---|---|
| 2023/0151725 | A1* | 5/2023 | Hovda | E21B 47/04 166/311 |
| 2023/0185979 | A1* | 6/2023 | Benkley | G06F 30/13 703/1 |
| 2024/0368978 | A1* | 11/2024 | Johnson | E21B 44/00 |
| 2025/0277436 | A1* | 9/2025 | Uvarov | G06F 30/20 |

* cited by examiner

400

| Depth Segment | Measurement depth (m) | Differential Pressure Max (kPa) | Differential Pressure Min (kPa) | ROP Max (m/h) | ROP Min (m/h) | RPM Max (c/min) | RPM Min (c/min) | Torque Max (ft-lbf) | Torque Min (ft-lbf) | WOB Max (kdaN) | WOB Min (kdaN) |
|---|---|---|---|---|---|---|---|---|---|---|---|
| 1 | 1000 | 4355.7 | 3638.5 | 86.48 | 52.11 | 45.80 | 41 | 9749.6 | 7501.8 | 21.10 | 20.9 |
| 2 | 1047 | 3879 | 3079 | 79.49 | 34.96 | 40.10 | 29.5 | 7675 | 5755 | 18.30 | 11.7 |
| 3 | 1227 | 3817 | 2298 | 44.74 | 11.60 | 45.30 | 37.7 | 9791.6 | 7298.4 | 21.00 | 20.8 |
| 4 | 1933 | 3990 | 1833 | 54.2 | 14.73 | 45.20 | 7.6 | 12972.7 | 2427 | 19.60 | 14.8 |
| 5 | 2261 | 5256 | 4146 | 76.33 | 18.50 | 77.20 | 20.6 | 18394.8 | 3684.2 | 22.00 | 21.6 |

FIG. 4

SYSTEMS AND METHODS FOR DETERMINING DEPTH-DEPENDENT DRILLING PARAMETER LIMITS

CROSS REFERENCE TO RELATED APPLICATIONS

This application claims priority to and the benefit of U.S. Provisional Patent Application No. 63/648,226, filed on May 16, 2024, which is hereby incorporated by reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

A major pursuit in the oil and gas exploration industry is that of semi- and fully autonomous drilling. In order to facilitate autonomous systems adjusting, steering, or otherwise controlling downhole drilling operations, certain drilling parameter limits may be provided to define operational thresholds within which the autonomous system may operate while forming a target wellbore through various measurement depths. Identifying and defining these operational limits may be challenging, time-consuming, costly, and cumbersome. Thus, systems and methods for identifying drilling parameter limits for integration with downhole drilling system may be advantageous.

SUMMARY

In some embodiments, a method for forming a target wellbore, includes receiving reference wellbore data including drilling parameter data for a plurality of drilling parameters of one or more reference wellbores. The method includes selecting a segmentation parameter set and associated segmentation parameter data from the reference wellbore data, wherein the segmentation parameter set is a subset of one or more drilling parameters of the plurality of drilling parameters, and the segmentation parameter data is a subset of the drilling parameter data corresponding to the one or more drilling parameters of the segmentation parameter set. The method includes segmenting the reference wellbore data into a plurality of depth segments using a statistical segmentation model and based on the segmentation parameter data. The method further includes generating a drilling parameter roadmap based on identifying a segment threshold for each drilling parameter of the reference wellbore data at each of the plurality of depth segments. The method also includes providing the drilling parameter roadmap for forming the target wellbore based on the segment thresholds for each drilling parameter of the plurality of drilling parameters. In some embodiments, the method is performed by a system. In some embodiments, the method is implemented as instructions stored in a computer-readable storage medium.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 illustrates an example environment in which a parameter roadmap system is implemented, according to at least one embodiment of the present disclosure;

FIG. 2-2 illustrates an example implementation of a parameter roadmap system as described herein, according to at least one embodiment of the present disclosure;

FIG. 3-1 illustrates an example of reference wellbore data, according to at least one embodiment of the present disclosure;

FIG. 3-2 is an example of a segmentation parameter set and associated segmentation parameter data, according to at least one embodiment of the present disclosure;

FIG. 3-3 illustrates an example of the reference wellbore data from FIG. 3-1;

FIG. 4 illustrates an example parameter roadmap, according to at least one embodiment of the present disclosure;

DETAILED DESCRIPTION

Figure 1:
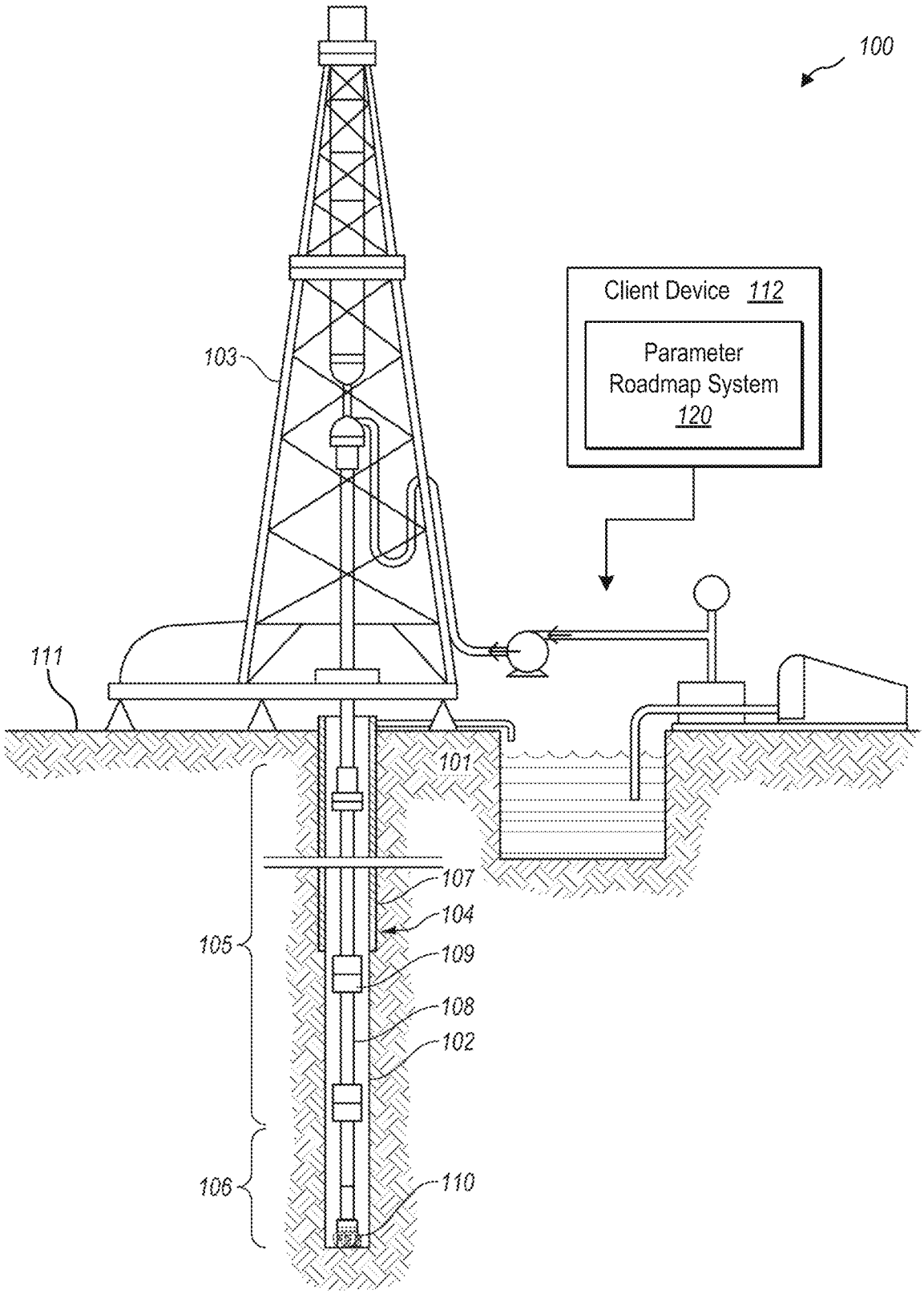
FIG. 1 is an example of a downhole system, according to at least one embodiment of the present disclosure.

This disclosure generally relates to systems and methods for generating parameter roadmaps for directing the application of drilling parameters for forming a target wellbore. A computer-implemented parameter roadmap system receives reference wellbore data for one or more reference offset wellbores. The reference wellbore data includes measurement data for a plurality of drilling parameters of the reference wellbores. For example, the reference wellbore data may indicate measurements for differential pressure, rate of penetration, weight on bit, torque, and rotational speed as implemented when forming various stages or depths of the reference wellbores. The reference wellbores may be selected from a plurality of offset wellbores based on the reference wellbores being similar in one or more regards to the target wellbore, such as offset wellbores that are physically and/or temporally proximate the target wellbore. In some cases, the parameter roadmap system transforms the, e.g., time-series measurement data of the reference data into a depth domain, as well as identifying and isolating instances of drilling within the reference wellbore data.

From the reference wellbore data, the parameter roadmap system selects a subset of the drilling parameters as a segmentation parameter set and associated segmenting parameter data. The parameter roadmap system leverages the segmentation parameter data to identify meaningful depth segments within the segmentation parameter data based on determining changepoints within the data. For example, the identified depth segments may correspond with different layers, formations, geological structures, or other features encountered as specific measurement depths when forming the reference wellbores. As another example, the identified segments may correspond with different downhole operations or downhole tools implemented to form the reference wellbores. The parameter roadmap system may then apply the identified depth segments to the reference wellbore data (e.g., to all of the remaining drilling parameters) in order to segment the reference wellbore data at the various measurement depths.

For each depth segment, the parameter roadmap system generates a segment threshold for each drilling parameter. For example, the segment threshold may include an upper limit, a lower limit, or both, and may be based on any relevant statistical property. In this way, the segment thresholds may represent an expected or predicted value or range of values for drilling parameters of a target wellbore at the associated measurement depths, for example, based on the similarity of the reference wellbore(s) to the target wellbore. The segment thresholds may facilitate directing a drilling operation, and more specifically controlling the drilling parameters, for forming the target wellbore in an efficient and effective manner. In particular, the segment thresholds may facilitate implementing an autonomous drilling system for automatically (e.g., without user input) controlling and making changes to drilling parameter values by providing meaningful limits to the changes the system can make, to ensure that the system operates efficiently and to ensure that the system does not stray too far from planned or safe parameter values.

As will be discussed in further detail below, the present disclosure includes a number of practical applications having features described herein that provide benefits and/or solve problems associated with determining drilling parameter roadmaps for downhole operations. Some example benefits are discussed herein in connection with various features and functionalities provided by a parameter roadmap system implemented on one or more computing devices. It will be appreciated that benefits explicitly discussed in connection with one or more embodiments described herein are provided by way of example and are not intended to be an exhaustive list of all possible benefits of the parameter roadmap system.

For example, as described herein, whether utilized for manual, semi-autonomous, or fully autonomous drilling, knowing and understanding meaningful thresholds for drilling parameters may be invaluable for efficient drilling, effective resource utilization, safe drilling operations, etc. Drilling parameter thresholds that are useful and meaningful (e.g., rather than default or overly general thresholds) for a specific planned or target wellbore may be determined based on observed drilling parameter measurement values for one or more offset wellbores that are similar to the target wellbore. However, determining and obtaining these thresholds, and doing so for more than a trivial range of measurement depths of the target wellbore, involves analyzing measurement data of a quantity that is not insignificant, and even for multiple drilling parameters. Such a task may generally be performed manually by a skilled or experienced well planning engineer, and may routinely take days to complete. Thus, not only do these conventional techniques come with a significant delay, but the sheer volume of time to complete such a tasks renders iterating the process, for example, for different use cases, depth segments, reference wellbores, etc., prohibitively impractical. The parameter roadmap system described herein, may implement the techniques of the present disclosure to generate a parameter roadmap in a matter of minutes or hours. In this way, meaningful limits to target drilling parameters may be generated in a quick and efficient manner to mitigate or eliminate bottlenecks to the drilling operation. Further, the parameter roadmap system facilitates iteratively exploring many different solutions for identifying thresholds for target drilling parameters.

In addition to generating parameter roadmaps in a significantly streamlined manner, the parameter roadmap system may be implemented without requiring significant computing resources, specialized hardware, etc. For example, some techniques may provide much more robust, thorough, and in-depth analysis of the reference wellbore data, and may employ highly sophisticated models to identify thresholds for drilling parameters. Such techniques, however, may be computationally expensive in order to achieve elevated levels of precision. For example, some conventional techniques may be employed to identify best-fit drilling parameter thresholds and for many or any measurement depth at a high level of resolution. In contrast, the parameter roadmap system employs simplified techniques that are not overly burdensome on computing resources, facilitating the application of the parameter roadmap system on practically any computing device. For example, by identifying depth segments based on only a subset of the drilling parameter data, and sometimes based on only one drilling parameter, the parameter roadmap system may quickly and easily identify depth segments that are applicable to all of the drilling parameters. Thus, the parameter roadmap system may implement a simpler analysis of a few drilling parameters rather than solving a complex, many-variable, problem. Further, by identifying several depth segments that represent the most significant and/or pronounced events, locations, geological features, etc. in the data, the parameter roadmap system further uses computing resources more efficiently than, for example, techniques that may identify changepoints at a much higher level of granularity.

Further, the parameter roadmap system advantageously facilitates the application of semi- and fully autonomous drilling systems that may be implemented to form wellbores with little to no human intervention. Such systems may help to more efficiently form a target wellbore based on the system making real-time decisions without relying on surface instruction, which may typically be received through mud-pulse or other telemetry techniques that are slow and have limited bandwidth. Thus, autonomous drilling systems may automatically (e.g., without user input) control drilling parameters and implement changes in order to from a wellbore in accordance with a wellbore plan or trajectory.

For autonomous drilling, however, it is imperative to impose limits to the extent of the changes that the drilling system may make to the drilling parameters. For instance, it can be critical to prevent the system from adjusting drilling parameters in a way that leads to inefficiencies in the drilling operation, or worse, unsafe drilling conditions. Thus, drilling parameter thresholds can provide safeguards to prevent excessive deviations of the drilling system from a wellbore plan. The parameter roadmap system also provides drilling parameter thresholds in the form of a parameter roadmap that are uniquely applicable and meaningful for specific drilling operations of a specific target wellbore. For instance, while default or overly generalized parameter thresholds may provide some of the benefits described herein at a general level, by generating the parameter roadmap based on reference wellbores that are identified as being specifically applicable to the target wellbore, the parameter roadmap indicates operational thresholds for the target drilling parameters that increase efficiency and safety based on the reference wellbores having encountered the same or similar features, conditions, etc. that the target wellbore may face. In this way, the parameter roadmap system facilitates the practical application of autonomous drilling systems forming wellbores with little or no user instruction.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. An example BHA 106 may include additional or other downhole drilling tools or components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system 100 may include other downhole drilling tools, components, and accessories such as special valves (e.g., kelly cocks, blowout preventers, and safety valves). Additional components included in the downhole system 100 may be considered a part of the drilling tool assembly 104, the drill string 105, or a part of the BHA 106, depending on their locations in the downhole system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to the surface 111 or may be allowed to fall downhole. The bit 110 may include one or more cutting elements for degrading the earth formation 101.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, or true north. Using measurements obtained with the geostationary position, the RSS may locate the bit 110, change the course of the bit 110, and direct the directional drilling tools on a projected trajectory. The RSS may steer the bit 110 in accordance with or based on a trajectory for the bit 110. For example, a trajectory may be determined for directing the bit 110 toward one or more subterranean targets such as an oil or gas reservoir.

The downhole system 100 may include or may be associated with a client device 112 with a parameter roadmap system 120 implemented thereon (e.g., or with a client application implemented thereon for accessing the parameter roadmap system 120 as described herein). The parameter roadmap system 120 may facilitate generating a parameter roadmap for a target wellbore to be drilled or formed (or a section of the target wellbore to be drilled or formed) based on identifying various depth segments of the target wellbore and establishing one or more thresholds for various drilling parameters at each depth segment.

Figures 1, 2:
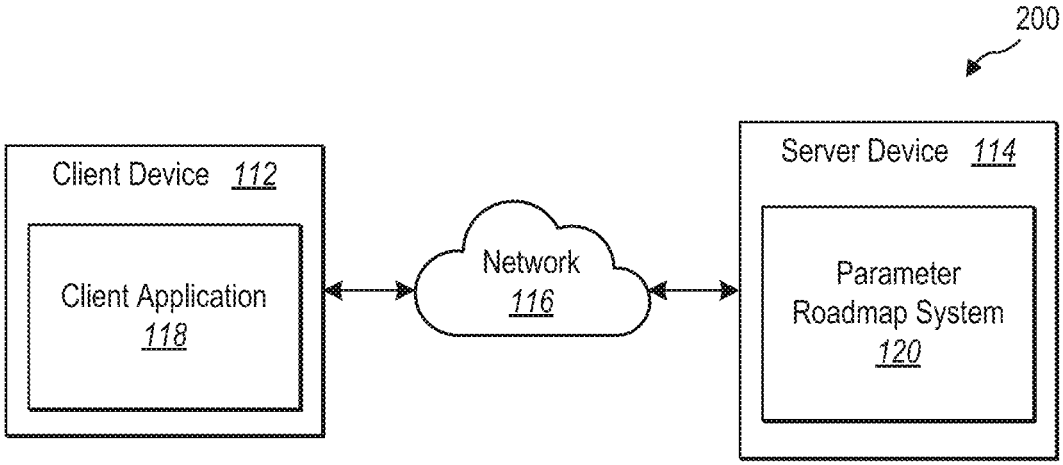
Figure 2:
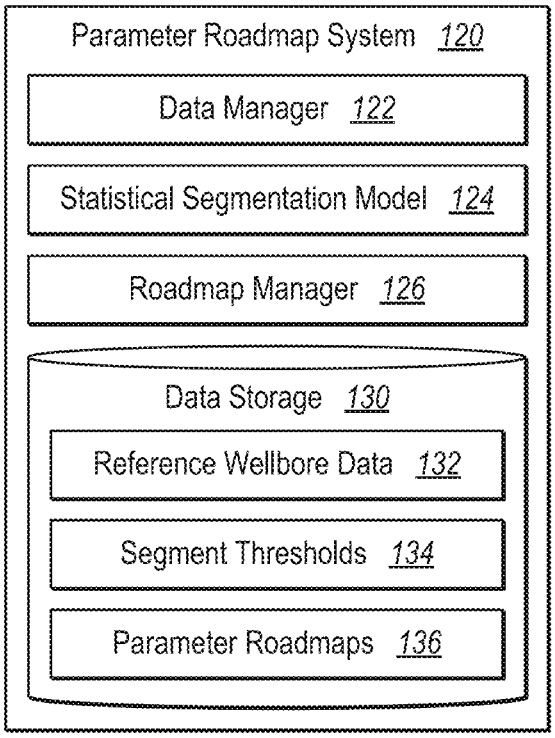

FIG. 2-1 illustrates an example environment 200 in which a parameter roadmap system 120 is implemented in accordance with one or more embodiments describe herein. As shown in FIG. 2-1, the environment 200 includes a server device 114. The server device 114 may include one or more computing devices (e.g., including processing units, data storage, etc.) organized in an architecture with various network interfaces for connecting to and providing data management and distribution across one or more client systems. As shown in FIG. 2-1, the server device 114 may be connected to and may communicate with (either directly or indirectly) a client device 112 through a network 116. The network 116 may include one or multiple networks and may use one or more communication platforms and/or technologies suitable for transmitting data. The network 116 may refer to any data link that enables transport of electronic data between devices of the environment 200. The network 116 may refer to a hardwired network, a wireless network, or a combination of a hardwired network and a wireless network. In one or more embodiments, the network 116 includes the internet. The network 116 may be configured to facilitate communication between the various computing devices via well-site information transfer standard markup language (WITSML) or similar protocol, or any other protocol or form of communication.

The client device 112 may be representative of one or multiple client devices, and may refer to various types of computing devices. For example, the client device 112 may include a mobile device such as a mobile telephone, a smartphone, a personal digital assistant (PDA), a tablet, a laptop, or any other portable device. Additionally, or alternatively, the client device 112 may include one or more non-mobile devices such as a desktop computer, server device, surface or downhole processor or computer (e.g., associated with a sensor, system, or function of the downhole system), or other non-portable device. In one or more implementations, the client device 112 includes graphical user interfaces (GUI) thereon (e.g., a screen of a mobile device). In addition, or as an alternative, the client device 112 may be communicatively coupled (e.g., wired or wirelessly) to a display device having a graphical user interface thereon for providing a display of system content. The server device 114 may similarly refer to various types of computing devices. Each of the devices of the environment 200 may include features and/or functionalities described below in connection with FIG. 6.

As shown in FIG. 2-1, the environment 200 may include a parameter roadmap system 120 implemented on the server device 114. While shown on the server device 114, the parameter roadmap system 120 may be implemented wholly or in part on the client device 112, across the server device 114 and the client device 112, or on or across one or more additional devices, such that different portions or components of the parameter roadmap system 120 are implemented on different computing devices in the environment 200. The client device 112 may include a client application 118. The client application 118 may include an application or interface for interacting with and/or receiving the features of the parameter roadmap system 120 as described herein. In some embodiments, one or more of the functionalities or features of the parameter roadmap system 120 may be carried out or performed on or by the client application 118. In this way, the environment 200 may be a cloud computing environment, and the parameter roadmap system 120 may be implemented across one or more devices of the cloud computing environment in order to leverage the processing capabilities, memory capabilities, connectivity, speed, etc., that such cloud computing environments offer in order to facilitate the features and functionalities described herein.

FIG. 2-2 illustrates an example implementation of the parameter roadmap system 120 as described herein, according to at least one embodiment of the present disclosure. The parameter roadmap system 120 may include a data manager 122, a statistical segmentation model 124, and a roadmap manager 126. The parameter roadmap system 120 may also include a data storage 130 having reference wellbore data 132, segment thresholds 134 and parameter roadmaps 136 stored thereon. While one or more embodiments described herein describe features and functionalities performed by specific components 122-126 of the parameter roadmap system 120, it will be appreciated that specific features described in connection with one component of the parameter roadmap system 120 may, in some examples, be performed by one or more of the other components of the parameter roadmap system 120.

By way of example, one or more of the data receiving, gathering, or storing features of the data manager 122 may be delegated to other components of the parameter roadmap system 120. As another example, while segment thresholds may be determined by the roadmap manager 126, in some instances, some or all of these features may be performed by the statistical segmentation model 124 (or other component of the parameter roadmap system 120). Indeed, it will be appreciated that some or all of the specific components may be combined into other components and specific functions may be performed by one or across multiple components 122-126 of the parameter roadmap system 120.

Additionally, while FIG. 1, for example, depicts the parameter roadmap system 120 implemented on a client device 112 of the downhole system, it should be understood that some or all of the features and functionalities of the parameter roadmap system 120 may be implemented on or across multiple client devices 112 and/or server devices 114. For example, reference wellbore data may be input and/or received by the data manager 122 on a (e.g., local) client device, and segmentation of the reference wellbore data may be performed on one or more of a remote, server, or cloud device. Indeed, it will be appreciated that some or all of the specific components 122-126 may be implemented on or across multiple client devices 112 and/or server devices 114, including individual functions of a specific component being performed across multiple devices.

As mentioned above, the parameter roadmap system 120 includes a data manager 122. The data manager 122 may receive a variety of types of data associated with the downhole system and may store the data to the data storage 130. The data manager 122 may receive the data from a variety of sources, such as from sensors, surveying tools, downhole tools, other (e.g., client) devices, libraries, databases, user input, etc.

In some embodiments, the data manager 122 receives reference wellbore data 132. The reference wellbore data 132 may be data associated with one or more reference wellbores. The reference wellbores of the reference wellbore data 132 may be offset wellbores that have a geographical relation to the target wellbore, such as wellbores within a same or similar oilfield or basin, or otherwise located within a given proximity to the target wellbore. The reference wellbores may be offset wellbores that have a temporal relation to the target wellbore, such as wellbores that were drilled, formed, or otherwise have been operated on within a given period of time. The reference wellbores may be offset wellbores that are otherwise related to the target wellbore, such as wellbores that traverse a similar formation, were formed with similar downhole operations or downhole tools configurations, or otherwise have other similar contextual features to the target wellbore.

The reference wellbore data 132 may include measurement data for various drilling parameters for downhole operations performed in the reference wellbores. For example, the reference wellbore data may include one or more of rate of penetration (ROP) data, weight on bit (WOB) data, torque data, rotational speed (RPM) data, differential pressure data, and/or any other drilling parameter measurements associated with a downhole operation. In some embodiments, the reference wellbore data 132 includes measurement data for one or more (or all) downhole operations or phases of downhole operations such as drilling, reaming, tripping, circulating, etc. In some embodiments, as described herein, drilling parameter roadmaps may be generated for providing drilling parameter limits for instances of drilling of a target well. Accordingly, in some embodiments, the data manager 122 may identify instances of drilling in the reference wellbore data and may isolate or filter these instances of drilling. For example, the data manager 122 may identify downhole operations or phases in the reference wellbore data 132 that are not associated with drilling, (e.g., flat time) and may flag, remove, or otherwise indicate data that is associated with non-drilling operations.

In some embodiments, the data manager 122 cleans some or all of the reference wellbore data 132. For example, the data manager 122 may receive the reference wellbore data 132 in a variety of forms. The data manager 122 may profile the reference wellbore data to understand its structure, format, quality, etc., and based on the profiling, the data manager 122 may check for issues such as missing values, duplicate entries, outliers, inconsistent formats, etc. The data manager 122 may validate the reference wellbore data 132 against one or more predefined rules and/or standards such as verifying that reference wellbore data 132 is in an expect format or falls within an expected range. In some embodiments, the data manager 122 addresses any errors or inconsistencies in the reference wellbore data 132. For example, the data manager 122 may remove incorrect, inconsistent, or duplicate entries. In another example, the data manager 122 may correct incorrect, inconsistent, or missing entries, such as by estimating or averaging values based on an associated context. In another example, the data manager 122 may standardize the format or transform the format of the reference wellbore data 132 for consistency. In another example, the data manager 122 may flag data issues for manual review and/or may facilitate a user correcting data issues. In this way, the data manager 122 may facilitate identifying and/or correcting errors, inconsistencies, or inaccuracies in the reference wellbore data 132 to make the data more reliable and useful.

In some embodiments, the data manager 122 smooths some or all of the reference wellbore data 132. For example, the data manager 122 may receive, e.g., raw, measurement data which may exhibit noise, outliers, irregularities, etc., due to environmental factors, measurement errors and the like. To enhance data quality, the data manager 122 may smooth the data such as by applying a smoothing algorithm to reduce noise, stochastic features, peaks, or other signal artifacts while preserving inherent or essential features of the data. For instance, the data manager 122 may employ techniques such as moving averages, exponential smoothing, or kernel-based filters. In this way, the data manager 122 may achieve noise reduction and feature preservation to ensure accurate and reliable measurements of the reference wellbore data 132. The data manager 122 may smooth the reference wellbore data 132 at any point in the parameter roadmap workflow described herein. For example, in some embodiments, the data manager 122 smooths the reference wellbore data 132 prior to segmentation of the reference wellbore data 132. This may facilitate identification of more accurate and/or representative depth segments of the reference wellbore data 132 as described herein. In some embodiments, the data manager 122 smooths the reference wellbore data 132 before identifying segment thresholds (e.g., after segmentation), for example, to facilitate providing operational parameter limits for each depth segment that are more accurate and/or effective.

In some embodiments, the data manager 122 normalizes some or all of the reference wellbore data 132. For example, as mentioned above, the reference wellbore data may include measurement data for a variety of types of drilling parameters. The measurement data may include measurements of different units, in different scales, of different orders of magnitude, etc. The data manager 122 may normalize the reference wellbore data 132 to convert or relate the different measurement types to a common type or scale. The data manager 122 may normalized the reference wellbore data 132 based on any transformation function(s), unit conversion, feature scaling, or other normalization technique. For instance, the data manager 122 may implement Min-Max scaling, Z-score standardization, logarithmic transformations, power transformations, or any other data standardization technique, and combinations thereof. In this way, the data manager 122 may normalize the reference wellbore data 132 to facilitate meaningfully comparing the data for the various drilling parameters across the different measurement types.

In some embodiments, the data manager 122 normalizes some or all of the reference wellbore data 132 (e.g., the measurement data for all of the drilling parameters). In some embodiments, the data manager 122 only normalizes some of the reference wellbore data 132, such as, for example, only the measurement data for those drilling parameters used for determining the depth segments (e.g., a segmentation parameter set as described herein). In some embodiments, the data manager 122 may maintain the original, un-normalized data and/or may transform the normalized data back to the native scale, units, etc. of the underlying drilling parameters. For example, the data manager 122 may normalize some or all of the reference wellbore data 132 to facilitate segmenting the reference wellbore data 132 while still providing the underlying reference wellbore data in its original or un-normalized form for use in identifying thresholds or limits within the data, generating and/or presenting the parameter roadmap, etc., as described herein.

In some embodiments, the data manager 122 receives the reference wellbore data 132 as time-series measurement data. For example, the reference wellbore data 132 may be data collected from various sensors and instrumentation during a drilling operation of one or more reference wellbores, and the data may be collected as measurement signals with timestamps, or in a time domain. The data manager 122 may transform or convert these temporal measurement signals to a depth reference frame along the (e.g., target and/or offset) wellbore(s). For instance, the data manager 122 may establish a relationship or calibration between the timestamps of the measurement data and wellbore depth based on known drilling parameters such as ROP, based on physical or virtual models of the wellbore and/or formations, based on specific depth reference points or geological markers, etc. In some embodiments, the data manager 122 may interpolate or extrapolate the time-series data to fit or align with a depth scale. In this way, the reference wellbore data 132 may be represented with respect to wellbore depth, for example, to facilitate a more meaningful visualization, analysis, and understanding of the various drilling parameters of the reference wellbore data 132.

As mentioned, in some embodiments, the data manager 122 may receive or may have access to wellbore data for many different offset wellbores. In some embodiments, the data manager may select the reference wellbore data 132 by selecting one or more (e.g., a subset) of the offset wellbores as the reference wellbores. For example, the data manager 122 may select, from a set of offset wellbores, one or more reference wellbores that are more or most representative of the target wellbore. For instance, the data manager 122 may select one or more offset wellbores that are in closes physical proximity to the target wellbore. In another example, the data manager 122 may select one or more offset wellbores that were drilled or operated on most recently. The data manager 122 may select one or more offset wellbores that have any other similarity to the target wellbore. For example, the data manager 122 may receive contextual information related to the offset wellbores (and the target wellbore) and the data manager 122 may select one or more offset wellbores that are contextually similar in one or more ways. For instance, the data manager 122 may select one or more offset wellbores based on the offset wellbores having similar trajectories, similar downhole operations, similar downhole tools or tool configurations, or any other contextual similarities.

Figures 1, 3:
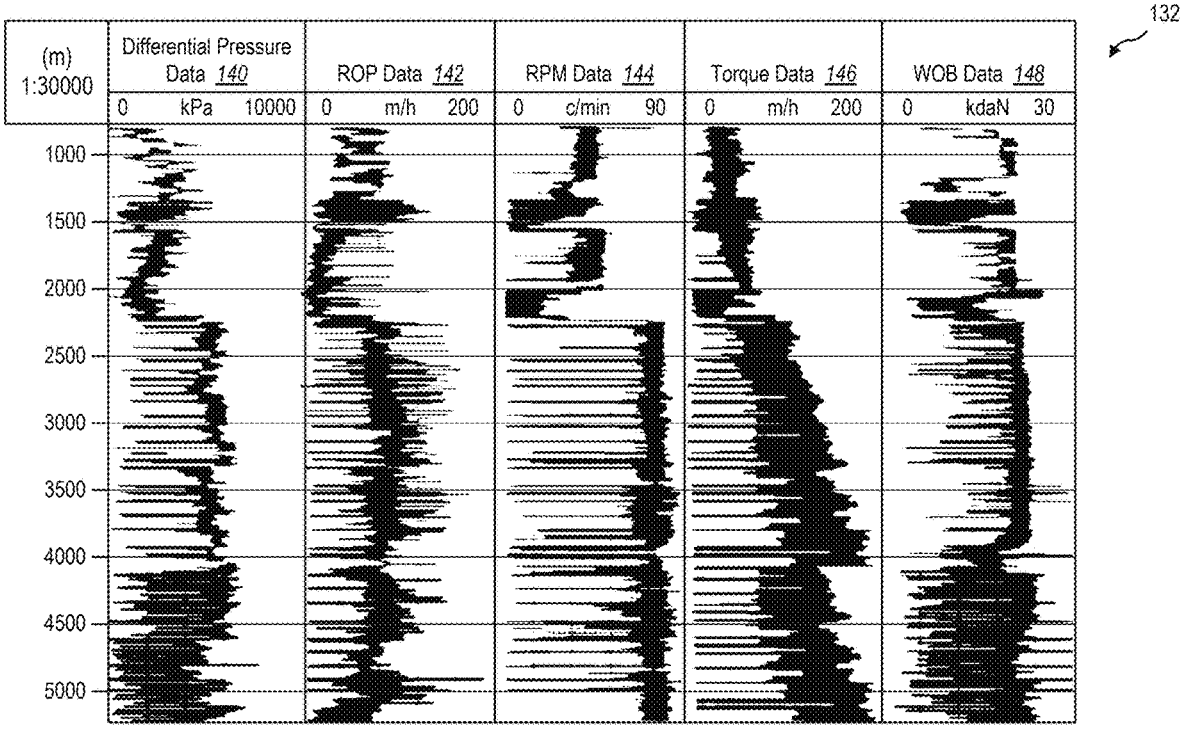
Figures 2, 3:
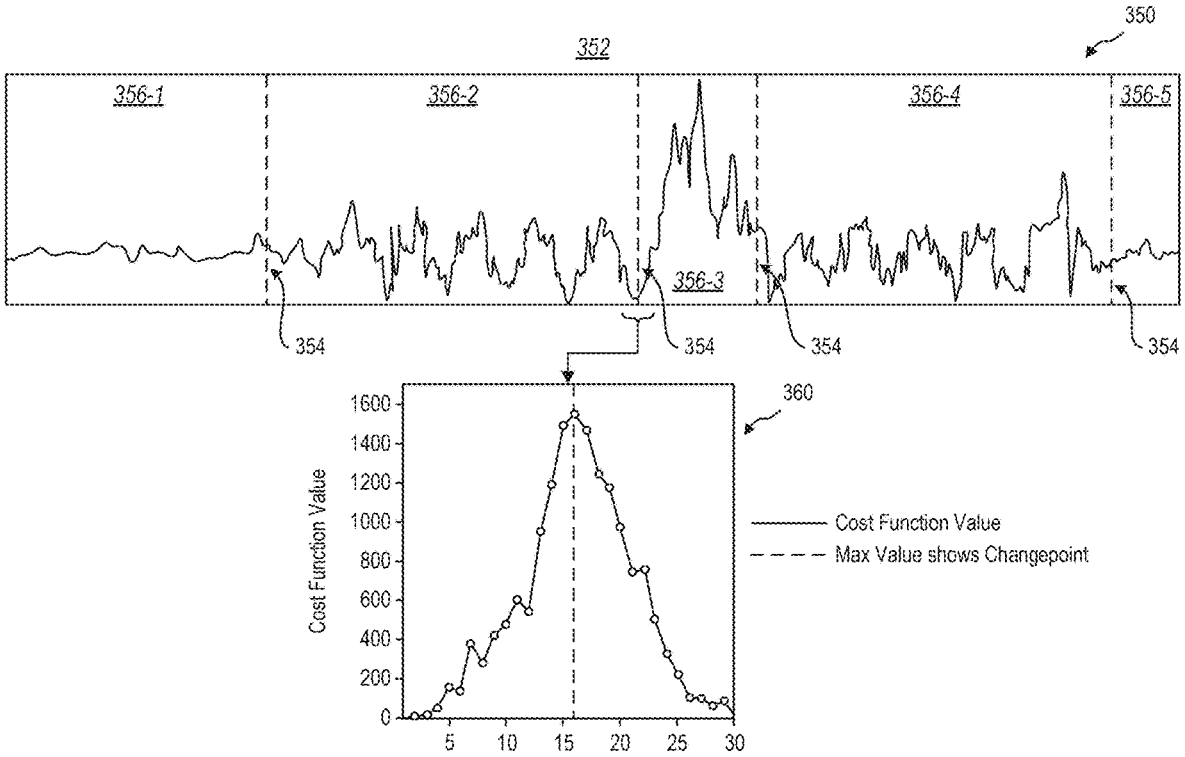
Figure 3:
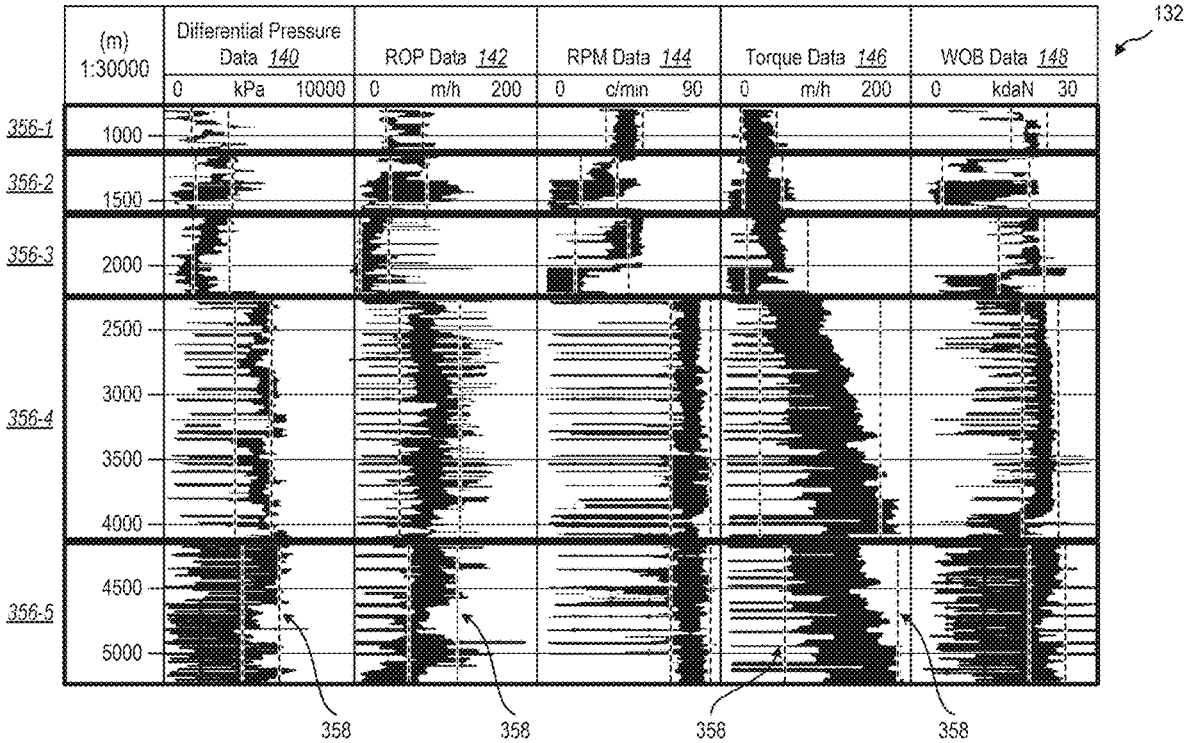

FIG. 3-1 illustrates an example of the reference wellbore data 132 that the data manager 122 may receive, according to at least one embodiment of the present disclosure. As mentioned above, the reference wellbore data 132 may include measurement data for a variety of different drilling parameters. For instance, the reference wellbore data 132 may include differential pressure data 140, ROP data 142, RPM data 144, torque data 146, and WOB 148. The reference wellbore data 132 may include all or may omit one or more of these types of these data, and/or may include any other measurement data for any other type of drilling parameter.

The reference wellbore data 132 may be measurement data from a single reference wellbore, or may include data from several reference wellbores. For example, the data manager 122 may identify and select a single reference wellbore that is most similar to or most representative of the target wellbore and may receive the measurement data for that reference wellbore as the reference wellbore data 132. In another example, the data manager 122 may identify two or more reference wellbores as being representative of the target wellbore and may receive and implement the measurement data for those selected reference wellbores as the reference wellbore data 132. For example, the reference wellbore data 132 may include the (e.g.) raw measurement signals for each of the selected reference wellbores and for each drilling parameters. In some embodiments, the data manager 122 may aggregate the measurement data for the various reference wellbores as a single set of data for each drilling parameter. For example, the data manager 122 may aggregate the measurement data for a given drilling parameter (and for each drilling parameter) through a summation, an average, a weighted average, a geometric mean, or any other statistical or mathematical operation of the measurement data for the reference wellbores.

In some embodiments, the data manager 122 may generate synthetic measurement data for implementing as the reference wellbore data 132. For example, the data manager 122 may aggregate portions of the measurement data from one or more reference wellbores in order to generate a single synthetic measurement data signal for each drilling parameter. For instance, the data manager 122 may identify a reference wellbore having a best, ideal, or otherwise desirable performance for one or more drilling parameters at a given measurement depth or range of measurement depths, and may utilize the measurement data (e.g., for all of the drilling parameters) from that reference wellbore and for that measurement depth as the reference wellbore data 132. Similarly, for one or more other measurement depths (e.g., range of measurement depths), the data manager 122 may identify a different reference wellbore exhibiting a desirable performance for a (same or different) drilling parameter, and may implement the associated measurement data for the drilling parameters as the reference wellbore data 132 for those other measurement depths. In a particular example, the data manager 122 may select, for a given measurement depth range, the measurement data (for all of the drilling parameters) for a reference wellbore that exhibited a best or highest ROP to implement as the reference wellbore data 132. The data manager 122 may generate the reference wellbore data 132 in this way by piecing together measurement data from any number of reference wellbores and for any number of measurement depth ranges. In this way, the data manager 122 may generate synthetic measurement data as the reference wellbore data 132 in order to simulate a wellbore that exhibited an optimal performance for a given drilling parameter at one or more measurement depths, such as simulating a wellbore having exhibited an ideal or best ROP throughout one or more (or all) measurement depths.

In some embodiments, the data manager 122 receives user input. The data manager 122 may receive the user input, for example, via any of the client devices 112 and/or server devices 114. Any of the data described herein may be input or augmented via the user input. For example, in some instances, some or all of the reference wellbore data 132 is received by the data manager 122 as user input.

In some embodiments, user input is received in association with one or more functions or features of the parameter roadmap system 120. For example, user input may indicate one or more reference wellbores from a set of offset wellbores to utilize for the reference wellbore data 132. In another example, user input can indicate a selection of measurement data and/or measurement depth ranges for generating synthetic data for the reference wellbore data 132. In some examples, user input can indicate a quantity of changepoints and/or depth segments to identify in the reference wellbore data 132, a minimum distance for identifying depth segments, or manual adjustment of one or more depth segments as described herein. In various instances, user input can indicate an amount of drilling parameters and/or which drilling parameters to use for segmentation of the reference wellbore data as described herein. Indeed, any of the functionalities of the parameter roadmap system 120 may be implemented in connection with, or may be augmented by, user input received via the data manager 122.

As mentioned above, the parameter roadmap system 120 includes a statistical segmentation model 124. The statistical segmentation model 124 may segment, partition, and/or split the reference wellbore data 132 into two or more depth segments corresponding to ranges of measurement depths of the target and reference wellbores. The statistical segmentation model 124 may segment the data in order to identify locations in the data, (and accordingly locations in the reference wellbore(s)) where a shift in the data occurs. These data shifts may correspond to different drilling conditions, geological layers, equipment states, etc. that were encountered when forming the reference wellbore(s), and which may likely be encountered in the target wellbore at the same or similar measurement depth. Thus, the statistical segmentation model 124 may identify and segment the reference wellbore data 132 in order to facilitate defining meaningful thresholds or limits for the drilling parameters at each depth segment for the target wellbore as described herein.

The statistical segmentation model 124 may segment the reference wellbore data 132 based on the measurement data from one or more of the drilling parameters of the reference wellbore data 132. For instance, the statistical segmentation model 124 may select one or more (e.g., a subset) of the drilling parameters as a segmentation parameter set for use in segmenting the reference wellbore data 132. The segmentation parameter set may be a set of one or more key drilling parameters that is selected to represent, or be indicative of, the behavior of the (e.g., operations of the) reference wellbore(s). For example, the segmentation parameter set may be one or more drilling parameters that are more important, valuable, or crucial to a given drilling operation. In another example, the segmentation parameter set may be one or more drilling parameters having characteristics that are understood to be most indicative of downhole conditions, formation properties, tool performance, or other characteristics. In some embodiments, the segmentation parameter set may be a default set of one or more drilling parameters and/or may be user defined.

In a particular example, the segmentation parameter set may be the ROP drilling parameter. In another example, the segmentation parameter set may be the WOB drilling parameter. In some instances, the segmentation parameter set may be the ROP and WOB drilling parameters. The segmentation parameter set may be any other drilling parameter and/or combination of drilling parameters. For example, the segmentation parameter set may include all of the drilling parameters of the reference wellbore data 132.

While segmentation of the reference wellbore data 132 may be performed as described herein based on any number of available drilling parameters (and associated measurement data), and in some cases can be performed based on all of the available drilling parameters, in some embodiments, segmenting the data based on such a robust set of drilling parameters may be time-consuming, may require considerable computing resources, and/or may provide only marginal improvements over segmentation based on a reduced number of drilling parameters. For example, while segmentation may be performed by accounting for many (or all) drilling parameters, and in some cases such segmentation may even be more accurate and/or a better fit for the underlying reference wellbore data, in many cases such a robust segmentation in this manner may be computationally expensive and provide delayed results. Thus, in some embodiments, the statistical segmentation model 124 may perform segmentation based on only one or two drilling parameters in order to provide adequate results in a timely manner and while utilizing computing resources more efficiently.

For example, in some embodiments, the statistical segmentation model 124 may perform segmentation based on the ROP and WOB drilling parameters. To elaborate, these drilling parameters may be identified as providing an adequate characterization of wellbore properties as a sufficient compromise between efficiency and accuracy. Thus, computing resources may be better leveraged to provide quality and timely drilling parameter roadmaps for a target wellbore based on only ROP and WOB, for example, as opposed to a more costly, complex (e.g., many-variable) analysis of more or all of the drilling parameters which, from a practical standpoint, may not even provide significant improvements.

In accordance with the segmentation parameter set, the statistical segmentation model 124 may identify the corresponding measurement data for the selected drilling parameters of the segmentation parameter set as segmentation parameter data. FIG. 3-2 is an example of a segmentation parameter set 350 and associated segmentation parameter data 352. The segmentation parameter set 350 in this example may be a singular drilling parameter (e.g., ROP), but as mentioned, may also include a set of multiple drilling parameters.

Based on the segmentation parameter set 350 and the segmentation parameter data 352, the statistical segmentation model 124 may determine depth segments for the reference wellbore data 132 in a variety of different ways. In some embodiments, the statistical segmentation model 124 may determine depth segments for the reference wellbore data 132 based on identifying changepoints 354 in the segmentation parameter data 352. The changepoints 354 may correspond to identified shifts, abrupt changes, or other features within the segmentation parameter data 352.

In some embodiments, the statistical segmentation model 124 identifies the changepoints 354 based on statistical properties of the segmentation parameter data 352. For example, the statistical segmentation model 124 may analyze various statistical properties of the segmentation parameter data 352 such as population and/or sample means, medians, modes, averages, variances, standard deviations, spreads, minima, maxima, ranges, quartiles, or any other statistical property, value, characteristic, or custom cost function based on any statistical property relevant to the dataset. The statistical segmentation model 124 may identify one or more changes in these statistical properties of a threshold amount in order to select the changepoints 354. For instance, the statistical segmentation model 124 may pinpoint moments of significant change in the segmentation parameter data 352 based on examining abrupt changes in the mean value of the data, identifying shifts in the variance or spread of the data, or detecting alterations in the underlying distribution of the data (e.g., Gaussian to exponential).

In some embodiments, the segmentation may be a binary segmentation technique such that the statistical segmentation model 124 may recursively split the data into two additional segments at each changepoint 354. This binary approach may simplify the overall structure of the statistical segmentation model 124 while capturing essential transitions in the data.

In some examples, the statistical segmentation model 124 may implement a cost function 360 for analyzing and quantifying the cost of splitting the segmentation parameter data 352 at any specific location. The cost function may facilitate quantifying, considering, and/or comparing factors such as variance, smoothness, quality of fit, and entropy of the resulting segments of the segmentation parameter data 352. The cost function may penalize complexity and excessive fragmentation by considering the number of segments created. For example, the cost function may be constrained by a (e.g., default and/or user defined) minimum segment length or segment distance, corresponding to a minimum range of measurement depth that a depth segment may span. In some embodiments, the statistical segmentation model 124 may be constrained to identify a certain number of changepoints 354, such as an optimal or best fit number of changepoints 354, or other user-defined quantity. In this way, the cost function 360 may effectively capture meaningful transitions while minimizing the overall complexity of the segmentation and avoiding unnecessary fragmentation.

In some embodiments, the cost function 360 may be implemented in accordance with the following formula for determining the cost of splitting the segmentation parameter data 352, or determining a changepoint 354, at a point d:

$$\text{Cost}(d) = \text{Total Variance} - [(\text{Variance before } d) + (\text{Variance after } d)]$$

The statistical segmentation model 124 may accordingly identify instances in the resulting cost function 360 where the cost is at a maximum for identifying where significant shifts in the segmentation parameter data 352 occurs. For instance, the cost function 360 may exhibit several or many local maxima, and the statistical segmentation model 124 may identify these maxima as changepoints 354. The cost function 360 may be implemented in accordance with any other formula and/or changepoints 354 may be determined in accordance with any other suitable means. For example, the cost function 360 may incorporate other statistical properties of the segmentation parameter data 352, for example, in addition to or as an alternative to variance.

As described herein, in some embodiments the segmentation parameter set 350 may include 2 or more drilling parameters. Accordingly, the cost function 360 may be implemented to factor in data points and/or statistical properties of the 2 or more drilling parameters and associated measurement data. For example, the cost function 360 may be a multi-variable function and/or may represent the splitting of the segmentation parameter data 352 as an n-dimensional cost. For example, the statistical segmentation model 124 may identify maxima in the cost function 360 with respect to an n-dimensional reference frame. In this way, the statistical segmentation model 124 may define changepoints 354 based on any number of drilling parameters of the segmentation parameter set 350.

After determining the changepoints 354, the statistical segmentation model 124 may define depth segments 356 within the segmentation parameter data 352 between the changepoints 354. For example, the statistical segmentation model 124 may define a first depth segment 356-1 from an initial reference point (e.g., the beginning) of the segmentation parameter data 352 to a first changepoint 354, and may define subsequent depth segments 356-2, 356-3, 356-4, 356-5, etc., between consecutive pairs of changepoints 354. In this way, based on identifying the changepoints 354, the statistical segmentation model 124 may split the segmentation parameter data 352 into a plurality of depth segments 356, and each depth segment 356 may represent a portion of the reference wellbore(s) exhibiting some property that is similar or uniform throughout the depth segments and/or different from one or more other depth segments.

In some embodiments, the statistical segmentation model 124 may implement machine learning techniques to identify the changepoints 354 and/or define the depth segments 356. For example, the statistical segmentation model 124 may be a segmentation machine learning model that is generated to process measurement data for one or more drilling parameters and define depth segments within the measurement data. A segmentation machine learning model may be trained to process a singular drilling parameter to identify depth segments of the data that exhibit similar properties and/or may be trained to process multiple drilling parameters to identify depth segments of the associated measurement data that exhibit similar properties across the multiple drilling parameters. A segmentation machine learning model may implement any type of machine learning model, such as a neural network or deep learning model, a tree- or decision-based model, etc.

In some embodiments, a segmentation machine learning model may be trained based on supervised learning techniques. For example, labeled data may define ideal or desirable change points in a training set of measurement data for a give drilling parameter. For instance, the labeled data may be generated by a user such as a skilled or experienced drilling or well planning engineer. In some cases, labeled data may be generated based on known geological features, operational performance metrics, etc. For instance, survey measurements, geophysical models, well logs, and/or user observations may be implemented to identify, within the reference wellbore(s), important or notable changes in an underground formation, downhole operation, operation of a downhole tool, etc., which may be used to define desirable depth segments within the measurement data. Accordingly, the segmentation machine learning model may be trained based on the labeled data to predict meaningful depth segments within the measurement data that correspond with certain geological layers, subterranean features, operational conditions, downhole tool performance, etc.

In some embodiments, a segmentation machine learning model may be implemented with unsupervised learning techniques. For example, a segmentation machine learning model may be utilized to identify clusters in the measurement data for identifying unique patterns or segments within the data, for example, without any particularly defined direction, objective, or output labels for defining the segments. In this way the segmentation machine learning model may discover unique patterns, structure, or relationships within the data without any specific guidance.

After identifying the changepoints 354 and/or depth segments 356, the statistical segmentation model 124 may apply the depth segments 356 to the (e.g., remaining drilling parameters of the) reference wellbore data 132. FIG. 3-3 illustrates an example of the reference wellbore data 132 of FIG. 3-1. As shown, the statistical segmentation model 124 may apply the depth segments 356 to the various drilling parameters of the reference wellbore data 132. As mentioned above, the depth segments 356 may be defined so as to characterize or represent locations or depths within the reference wellbore(s) exhibiting similar properties or features. By defining the depth segments and applying them across all of the drilling parameters of the reference wellbore data 132, the depth segments may isolate or highlight the expected behavior for each of the drilling parameters for the given measurement depth ranges within the target wellbore. In this way, the depth segments 356 may be determined based on a subset (e.g., 1) of the drilling parameters, but may be applicable to all of the drilling parameters of the reference wellbore data 132.

As mentioned above, the parameter roadmap system 120 includes a roadmap manager 126. In some embodiments, the roadmap manager 126 determines one or more thresholds or limits for one or more drilling parameters of the reference wellbore data 132. For instance, the roadmap manager 126 may determine thresholds for one or more (or all) of the drilling parameters of the reference wellbore data 132 based on the depth segments 356 identified by the statistical segmentation model 124.

In some embodiments, the roadmap manager 126 determines one or more segment thresholds 358. Each segment threshold 358 may be applicable to a given drilling parameter, and may be a threshold, limit, or other bound of the drilling parameter for a given depth segment 356. For example, the segment thresholds 358 may include an upper limit and/or a lower limit for a drilling parameter at a given depth segment 356. In some embodiments, the roadmap manager 126 determines segment thresholds 358 for each drilling parameter and for each depth segment 356. In other embodiments, the roadmap manager 126 determines segment thresholds 358 for only some of the drilling parameters and/or for only some of the depth segments 356.

The roadmap manager 126 may determine the segment thresholds 358 based on one or more statistical values, ranges, properties, or other characteristic of (the measurement data of) a depth segment 356 of a drilling parameter. For example, the roadmap manager 126 may determine an upper and/or lower limit of the measurement data based on a percentile or complimentary pair of percentiles. For example, one or more segment thresholds 358 may be determined for the measurement data at a $10^{th}$ percentile, $25^{th}$ percentile, $75^{th}$ percentile, $90^{th}$ percentile, etc. In another example, one or more segment thresholds 358 may be determined based on a mean, median, mode, average, standard deviation, variance, quartile, or any other statistical measure. In accordance with at least one embodiment of the present invention, the roadmap manager 126 may determine, for each drilling parameter and at each depth segment 356, segment thresholds 358 corresponding to an upper limit and a lower limit based on complimentary pairs of percentile values, such as 25% and 75% of the measurement data, 10% and 90% of the measurement data, or any other percentile limits.

In this way, each drilling parameter may be characterized at each depth segment 356 by one or more segment thresholds 358 (e.g., upper and lower limits). Based on the underlying reference wellbore data 132 (and the associated refence wellbore(s)) being similar to or representative of a target wellbore, the segment thresholds 358 may provide an expected or predicted value or range of values through the various measurement depths or the target wellbore for each drilling parameter that may be employed for forming the target wellbore. For instance, in the example shown in FIG. 3-3, based on the depth segment 356-3, it can be expected that the RPM of the target wellbore from about 1400 m to about 2200 m will be within the range of 20 RPM to about 50 RPM, based on the associated segment thresholds 358. Similarly, the WOB can be expected to be within the range of about 13 KdaN to about 20 KdaN.

The depth segments 356 and associated segment thresholds 358 for each drilling parameter may be valuable for understanding how a downhole tool and/or downhole system may behave at various stages of forming a target wellbore. For example, the segment thresholds 358 may informing planning and/or executing of the target wellbore by understanding how to best form the target wellbore, which operations and/or tools to implement, how to efficiently and effectively utilize resources, where different formation and/or layers may be encountered in the target wellbore, among other knowledge.

In some embodiments, a downhole system may be implemented as a semi- or fully autonomous system for automatically forming a target wellbore with little or no user input. For example, an autonomous system can make real-time decisions about wellbore steering, drilling parameters, etc., with little or no human intervention. The benefits of such systems are numerous, not least of which may be the increased efficiency and speed with which a target wellbore may be formed based on faster, real-time decision making. For example, conventional drilling systems may be operated based on a control loop that includes data acquired and sent to the surface, decision making at the surface, and instructions sent downhole from the surface. This information is transmitted based on sending and receiving downlink communications through mud-pulse telemetry or other downhole telemetry techniques which can have significant latency, limited bandwidth, etc. Thus, enabling a drilling system to make autonomous, real-time, decisions can lead to more efficient drilling operations.

In some embodiments, the depth segments 356 and associated segment thresholds 358 for each drilling parameter may facilitate automation of one or more downhole tasks. For example, while semi- or fully autonomous drilling systems may make decisions without human intervention, it may be important to define certain operational limits or thresholds within which the system is defined to operate. For example, operational limits may ensure that the system operates within safe and optimal ranges to minimize deviations from a wellbore plan or trajectory. For instance, without such limits, a system might make extreme adjustments that lead to inefficiencies or even equipment damage or operational failures. Defining operational limits, for example, for drilling parameters, may facilitate an autonomous system adjusting these drilling parameters to stay on course while preventing excessive deviations.

In some embodiments, the roadmap manager 126 may generate a parameter roadmap which may enumerate, record, or otherwise contain various segment thresholds for the various drilling parameters and at the various depth segments. For example, the parameter roadmap may be a table of values, data file, plot, figure, graph, or any other form of indicating the depth segments and associated segment thresholds.

FIG. 4 illustrates an example parameter roadmap 400, according to at least one embodiment of the present disclosure. The parameter roadmap 400 may indicate one or more depth segments and associated measurement depths of the depth segment as described above. For each depth segment, the parameter roadmap 400 may indicate one or more associated segment thresholds. For example, as shown in FIG. 4, the parameter roadmap 400 may indicate one or more drilling parameters as described herein, and for each drilling parameter, the parameter roadmap 400 may indicate one or more corresponding segment thresholds for the drilling parameter at each depth segment. In particular, the parameter roadmap 400 may indicate an upper and lower limit for each drilling parameter at each depth segments. In some embodiments, the parameter roadmap 400 may indicated several upper and/or lower limits for each drilling parameter at each depth segment, such as a 10% lower limit, a 20% lower limit, a 75% upper limit, and a 90% upper limit. In this way, the parameter roadmap 400 may indicate the operational limits within which each drilling parameters should be operated in order to form a target wellbore efficiently and effectively.

In some embodiments, the roadmap manager 126 may provide the parameter roadmap 400 for indicating, instructing, or otherwise facilitating the forming and/or steering of a target wellbore. For instance, the roadmap manager 126 may plot, display, or otherwise generate a report for presenting to indicate the parameter roadmap 400 and the associated segment thresholds. In this way, the parameter roadmap may facilitate, for example, a drilling engineer making decisions and implementing changes to a drilling operation based on the segment thresholds.

In another example, the roadmap manager 126 may provide the parameter roadmap 400 to another component, module, and/or system for facilitating semi- or fully autonomous drilling of a target wellbore. For example, the roadmap manager 126 may upload, transmit, or otherwise provide the parameter roadmap 400 as a data file or data object such that an autonomous drilling system may operate a downhole operation in accordance with the segment thresholds of the parameter roadmap 400.

For instance, based on a current measurement depth of a target wellbore, a drilling system may adjust, autonomously and without user input, a drilling parameter of the target wellbore to operate within an associated segment threshold for the drilling parameter as indicated at a depth segment corresponding to the current measurement depth. Indeed, the drilling system may operate autonomously to adjust one or more (or all) of the drilling parameters one or more (or many) times as the autonomous system controls a downhole operation to form the target wellbore, and may make such adjustments in accordance with the parameter roadmap to maintain each drilling parameter within the associated segment thresholds.

In this way, the parameter roadmap 400 may facilitate an autonomous drilling of a target wellbore based on imposing meaningful limits to the various drilling parameters that may be adjusted by an autonomous system. For example, because the segment thresholds are generated based on close or otherwise similar reference wellbores (and in some cases a synthetic reference wellbore with optimal performance), the segment thresholds may be uniquely and advantageously applicable to the target wellbore in order that the target wellbore may be formed efficiently and effectively.

Figure 5:
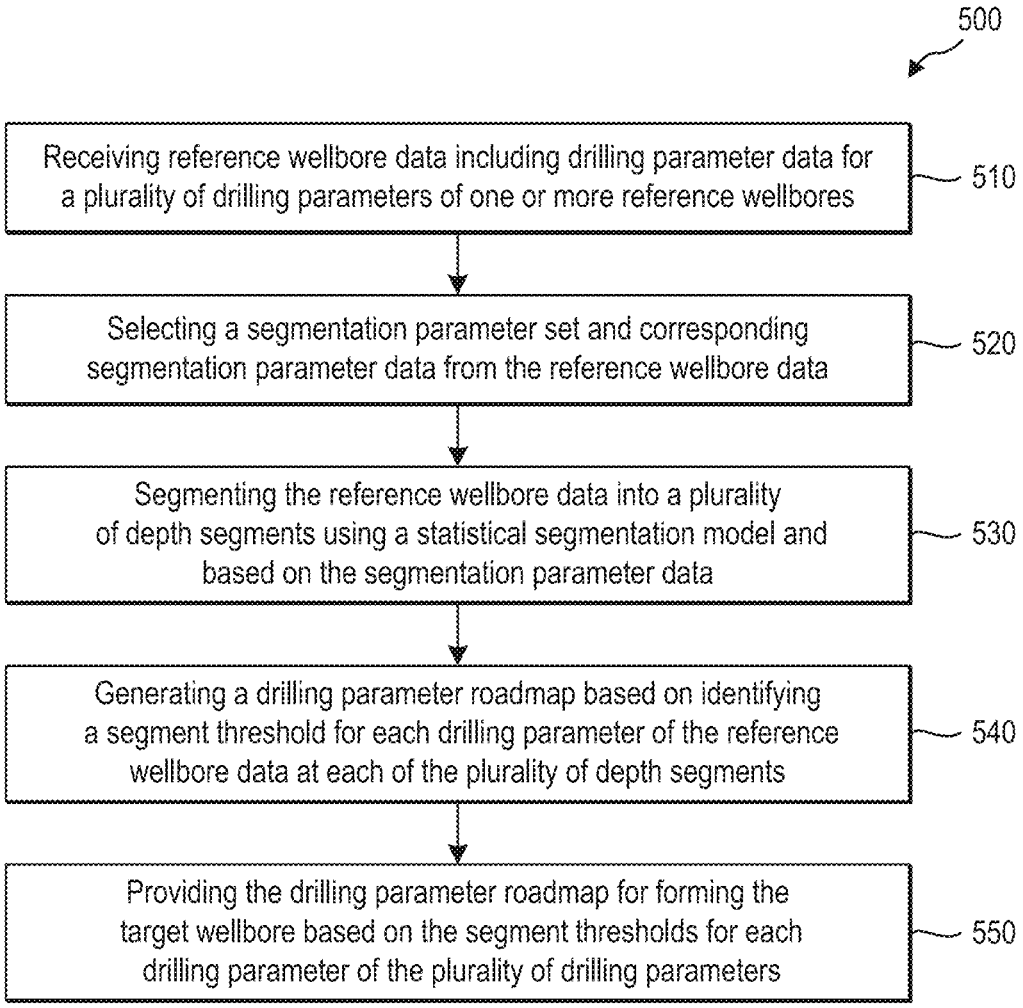
FIG. 5 illustrates a flow diagram for a method or a series of acts for forming a target wellbore as descried herein, according to at least one embodiment of the present disclosure.

FIG. 5 illustrates a flow diagram for a method 500 or a series of acts for forming a target wellbore as described herein, according to at least one embodiment of the present disclosure. While FIG. 5 illustrates acts according to one embodiment, alternative embodiments may add to, omit, reorder, or modify any of the acts of FIG. 5. In some embodiments, the acts of FIG. 5 may be performed as a method. In some embodiments, the acts of FIG. 5 may be performed by a system. In some embodiments, the acts of FIG. 5 may be implemented as instructions stored on a computer-readable storage medium.

In some embodiments, the method 500 includes an act 510 of receiving reference wellbore data including drilling parameter data for a plurality of drilling parameters of one or more reference wellbores. For example, the drilling parameters may include ROP, WOB, RPM, torque, and differential pressure. In some embodiments, the reference wellbore data is received as time-series measurement data, and the parameter roadmap system transforms the time-series measurement data into a depth domain. In some embodiments, the parameter roadmap system identifies instances of drilling within the reference wellbore data and filters the reference wellbore data to include only the instances of drilling. In some embodiments, the parameter roadmap system identifies a plurality of offset wellbores and associated wellbore data and selects, from the plurality of offset wellbores, one or more offset wellbores and associated wellbore as the reference wellbore data. For example, the one or more offset wellbores may be offset wellbores that are closest in proximity to the target wellbore. In another example, the one or more offset wellbores may be offset wellbores that are temporally closest to the target wellbore. In another example, the one or more offset wellbores may be offset wellbores that are most similar to the target wellbore based on contextual data. In some embodiments, the parameter roadmap system may identify a plurality of offset wellbores and associated wellbore data that are similar and/or applicable to the target wellbore, and may generate the reference wellbore data based on generating synthetic measurement data from the associated wellbore data of two or more of the offset wellbores. For example, the synthetic measurement data may include, for each measurement depth of the wellbore data of the plurality of offset wellbores, measurement data from an offset wellbore having a greatest ROP at the measurement depth.

In some embodiments, the method 500 includes an act 520 of selecting a segmentation parameter set and associated segmentation parameter data from the reference wellbore data, wherein the segmentation parameter set is a subset of one or more drilling parameters of the plurality of drilling parameters, and the segmentation parameter data is a subset of the drilling parameter data corresponding to the one or more drilling parameters of the segmentation parameter set.

In some embodiments, the method 500 includes an act 530 of segmenting the reference wellbore data into a plurality of depth segments using a statistical segmentation model and based on the segmentation parameter data. For example, the segmentation model may utilize a cost function based on one or more statistical properties of the segmentation parameter data in order to identify change points in the segmentation parameter data. In some embodiments, the segmentation parameter set includes two or more drilling parameters of the plurality of drilling parameters, and segmenting the reference wellbore data includes performing a multivariate segmentation of the reference wellbore data using the statistical segmentation model based on the two or more drilling parameters of segmentation parameter set. For example, the segmentation parameter set may include ROP data and WOB data. In some embodiments, the reference wellbore data of two or more drilling parameters is normalized and segmentation is performed on the normalized segmentation parameter data.

In some embodiments, the statistical segmentation model is a segmentation machine learning model that is generated to process source drilling parameter data to determine predicted depth segments having similarities across the source drilling parameter data. For instance, the statistical segmentation machine learning model may utilize supervised or unsupervised segmentation to determine the predicted depth segments.

In some embodiments, the method 500 includes an act 540 of generating a drilling parameter roadmap based on identifying a segment threshold for each drilling parameter of the reference wellbore data at each of the plurality of depth segments. For example, each segment threshold may identify, for each depth segment, an upper limit, a lower limit, or both for target drilling parameters for forming the target wellbore. For instance, the segment thresholds may be defined based on one or more statistical limits in the drilling parameters data for each drilling parameters of the reference wellbore data.

In some embodiments, the method 500 includes an act 550 of providing the drilling parameter roadmap for forming the target wellbore based on the segment thresholds for each drilling parameter of the plurality of drilling parameters.

In some embodiments, the method 500 includes receiving reference wellbore data including drilling parameter data for a plurality of drilling parameters of one or more reference wellbores; selecting a segmentation parameter set and associated segmentation parameter data from the reference wellbore data, wherein the segmentation parameter set is a subset of one or more drilling parameters of the plurality of drilling parameters, and the segmentation parameter data is a subset of the drilling parameter data corresponding to the one or more drilling parameters of the segmentation parameter set; segmenting the reference wellbore data into a plurality of depth segments using a statistical segmentation model and based on the segmentation parameter data; generating a drilling parameter roadmap based on identifying a segment threshold for each drilling parameter of the reference wellbore data at each of the plurality of depth segments; and performing a drilling operation to form a target wellbore at a measurement depth including adjusting, autonomously and without user input, a target drilling parameter to operate within an associated segment threshold of the drilling parameter roadmap at a depth segment corresponding to the measurement depth.

In some embodiments, the method 500 includes receiving reference wellbore data including drilling parameter data for a plurality of drilling parameters of one or more reference wellbores; selecting a segmentation parameter set and associated segmentation parameter data from the reference wellbore data, wherein the segmentation parameter set is a subset of one or more drilling parameters of the plurality of drilling parameters, and the segmentation parameter data is a subset of the drilling parameter data corresponding to the one or more drilling parameters of the segmentation parameter set; segmenting the reference wellbore data into a plurality of depth segments using a statistical segmentation model and based on the segmentation parameter data; generating a drilling parameter roadmap based on identifying a segment threshold for each drilling parameter of the reference wellbore data at each of the plurality of depth segments; and generating a report indicating the drilling parameter roadmap for one or more measurement depths of a target wellbore.

Figure 6:
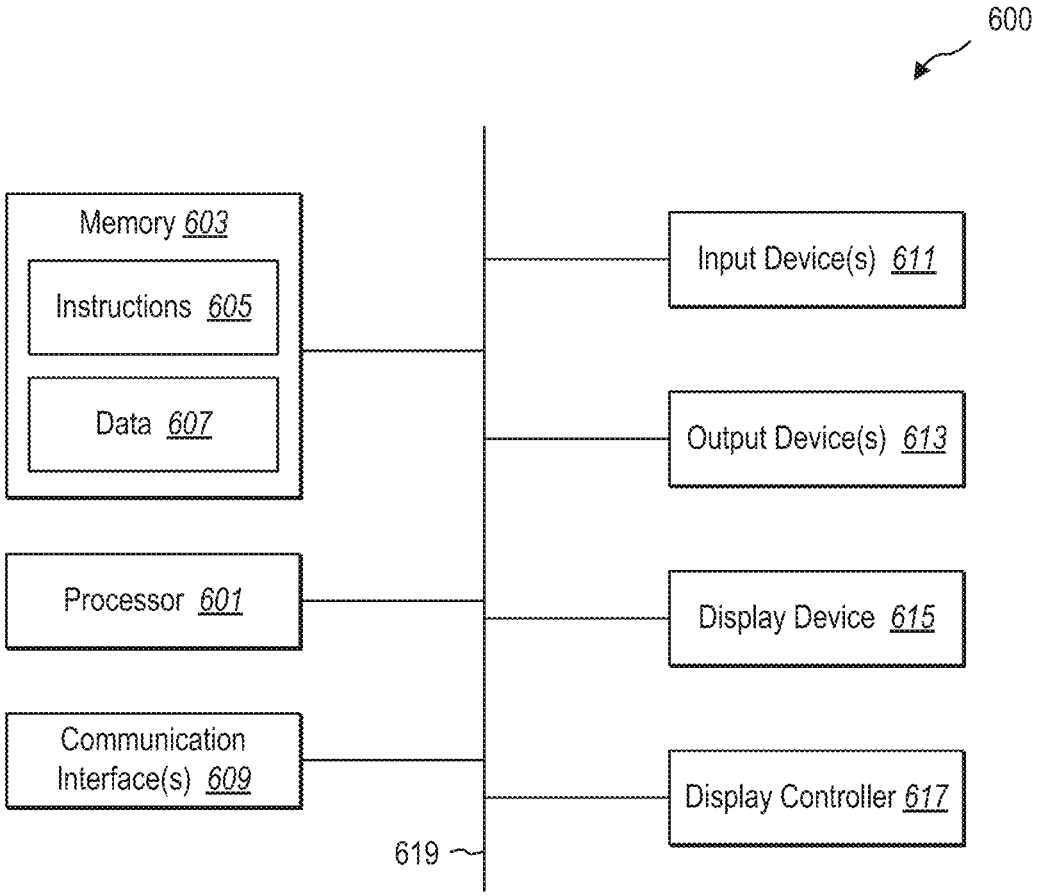
FIG. 6 illustrates certain components that may be included within a computing system.

Turning now to FIG. 6, this figure illustrates certain components that may be included within a computer system 600. One or more computer systems 600 may be used to implement the various devices, components, and systems described herein.

The computer system 600 includes a processor 601. The processor 601 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 601 may be referred to as a central processing unit (CPU). Although just a single processor 601 is shown in the computer system 600 of FIG. 6, in an alternative configuration, a combination of processors (e.g., an ARM and DSP) could be used.

The computer system 600 also includes memory 603 in electronic communication with the processor 601. The memory 603 may include computer-readable storage media and can be any available media that can be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure can comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored or in software, hardware, firmware, or combinations thereof.

Instructions 605 and data 607 may be stored in the memory 603. The instructions 605 may be executable by the processor 601 to implement some or all of the functionality disclosed herein. Executing the instructions 605 may involve the use of the data 607 that is stored in the memory 603. Any of the various examples of modules and components described herein may be implemented, partially or wholly, as instructions 605 stored in memory 603 and executed by the processor 601. Any of the various examples of data described herein may be among the data 607 that is stored in memory 603 and used during execution of the instructions 605 by the processor 601.

A computer system 600 may also include one or more communication interfaces 609 for communicating with other electronic devices. The communication interface(s) 609 may be based on wired communication technology, wireless communication technology, or both. Some examples of communication interfaces 609 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces 609 may connect the computer system 600 to a network. A "network" or "communications network" may generally be defined as one or more data links that enable the transport of electronic data between computer systems and/or modules, engines, or other electronic devices, or combinations thereof. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instruction or data structures and which can be accessed by a general purpose or special purpose computer.

A computer system 600 may also include one or more input devices 611 and one or more output devices 613. Some examples of input devices 611 include a keyboard, mouse, microphone, remote control device, button, joystick, trackball, touchpad, and lightpen. Some examples of output devices 613 include a speaker and a printer. One specific type of output device that is typically included in a computer system 600 is a display device 615. Display devices 615 used with embodiments disclosed herein may utilize any suitable image projection technology, such as liquid crystal display (LCD), light-emitting diode (LED), gas plasma, electroluminescence, or the like. A display controller 617 may also be provided, for converting data 607 stored in the memory 603 into one or more of text, graphics, or moving images (as appropriate) shown on the display device 615.

The various components of the computer system 600 may be coupled together by one or more buses, which may include one or more of a power bus, a control signal bus, a status signal bus, a data bus, other similar components, or combinations thereof. For the sake of clarity, the various buses are illustrated in FIG. 6 as a bus system 619.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures can be transferred automatically or manually from transmission media to non-transitory computer-readable storage media (or vice versa). For example, computer executable instructions or data structures received over a network or data link can be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media can be included in computer system components that also (or even primarily) utilize transmission media.

INDUSTRIAL APPLICABILITY

The following description from ¶å[0101]-[0120] includes various embodiments that, where feasible, may be combined in any permutation. For example, the embodiment of ¶[0101] may be combined with any or all embodiments of the following paragraphs. Embodiments that describe acts of a method may be combined with embodiments that describe, for example, systems and/or devices. Any permutation of the following paragraphs is considered to be hereby disclosed for the purposes of providing "unambiguously derivable support" for any claim amendment based on the following paragraphs. Furthermore, the following paragraphs provide support such that any combination of the following paragraphs would not create an "intermediate generalization."

In some embodiments, a method for forming a target wellbore includes receiving reference wellbore data including drilling parameter data for a plurality of drilling parameters of one or more reference wellbores, selecting a segmentation parameter set and associated segmentation parameter data from the reference wellbore data, wherein the segmentation parameter set is a subset of one or more drilling parameters of the plurality of drilling parameters, and the segmentation parameter data is a subset of the drilling parameter data corresponding to the one or more drilling parameters of the segmentation parameter set, segmenting the reference wellbore data into a plurality of depth segments using a statistical segmentation model and based on the segmentation parameter data, generating a drilling parameter roadmap based on identifying a segment threshold for each drilling parameter of the reference wellbore data at each of the plurality of depth segments, and providing the drilling parameter roadmap for forming the target wellbore based on the segment thresholds for each drilling parameter of the plurality of drilling parameters.

In some embodiments, the statistical segmentation model utilizes a cost function based on one or more statistical properties of the segmentation parameter data in order to identify change points in the segmentation parameter data.

In some embodiments, the segmentation parameter set includes 2 or more drilling parameters of the plurality of drilling parameters, and wherein segmenting the reference wellbore data includes performing a multivariate segmentation of the reference wellbore data using the statistical segmentation model based on the 2 or more drilling parameters of segmentation parameter set.

In some embodiments, segmenting the reference wellbore data includes normalizing the segmentation parameter data of the 2 or more drilling parameters of the segmentation parameter set, and performing the multivariate segmentation on the normalized segmentation parameter data.

In some embodiments, the segmentation parameter set includes rate of penetration (ROP) and weight on bit (WOB).

In some embodiments, the statistical segmentation model is a segmentation machine learning model that is generated to process source drilling parameter data to determine predicted depth segments having similarities across the source drilling parameter data.

In some embodiments, the segmentation machine learning model utilizes unsupervised segmentation to determine the predicted depth segments.

In some embodiments, the plurality of drilling parameters includes ROP, WOB, RPM, torque, and differential pressure.

In some embodiments, receiving the reference wellbore data includes receiving time-series measurement data and transforming the time-series measurement data to a depth domain.

In some embodiments, receiving the reference wellbore data includes identifying instances of drilling within the reference wellbore data and filtering the reference wellbore data to include only the instances of drilling.

In some embodiments, receiving the reference wellbore data includes identifying a plurality of offset wellbores and associated wellbore data, and selecting, from the plurality of offset wellbores, one or more offset wellbores and associated wellbore data as the reference wellbore data.

In some embodiments, selecting the reference wellbore data includes selecting one or more offset wellbores of the plurality of offset wellbores that are closest in proximity to the target wellbore.

In some embodiments, selecting the reference wellbore data includes selecting one or more offset wellbores of the plurality of offset wellbores that are temporally closest to the target wellbore.

In some embodiments. selecting the reference wellbore data includes selecting one or more offset wellbores of the plurality of offset wellbores that are most similar to the target wellbore based on contextual data.

In some embodiments. receiving the reference wellbore data includes identifying a plurality of offset wellbores and associated wellbore data, and generating the reference wellbore data based on generating synthetic measurement data from the associated wellbore data of two or more offset wellbores of the plurality of offset wellbores.

In some embodiments, generating the synthetic measurement data includes selecting, for each measurement depth of the wellbore data of the plurality of offset wellbores, measurement data from an offset well having a greatest ROP at the measurement depth.

In some embodiments, identifying the segment thresholds includes identifying, for each depth segment, an upper limit, a lower limit, or both, for target drilling parameters for forming the target wellbore.

In some embodiments, identifying the segment thresholds includes identifying, for each depth segment, one or more statistical limits in the drilling parameter data for each drilling parameter of the reference wellbore data.

In some embodiments a system includes at least one processor, memory in electronic communication with the at least one processor, and instructions stored in the memory, the instructions being executable by the at least one processor to receive reference wellbore data including drilling parameter data for a plurality of drilling parameters of one or more reference wellbores, select a segmentation parameter set and associated segmentation parameter data from the reference wellbore data, wherein the segmentation parameter set is a subset of one or more drilling parameters of the plurality of drilling parameters, and the segmentation parameter data is a subset of the drilling parameter data corresponding to the one or more drilling parameters of the segmentation parameter set, segment the reference wellbore data into a plurality of depth segments using a statistical segmentation model and based on the segmentation parameter data, generate a drilling parameter roadmap based on identifying a segment threshold for each drilling parameter of the reference wellbore data at each of the plurality of depth segments, and perform a drilling operation to form a target wellbore at a measurement depth including adjusting, autonomously and without user input, a target drilling parameter to operate within an associated segment threshold of the drilling parameter roadmap at a depth segment corresponding to the measurement depth.

In some embodiments a computer-readable storage medium includes instruction that, when executed by at least one processor, cause the processor to receive reference wellbore data including drilling parameter data for a plurality of drilling parameters of one or more reference wellbores, select a segmentation parameter set and associated segmentation parameter data from the reference wellbore data, wherein the segmentation parameter set is a subset of one or more drilling parameters of the plurality of drilling parameters, and the segmentation parameter data is a subset of the drilling parameter data corresponding to the one or more drilling parameters of the segmentation parameter set, segment the reference wellbore data into a plurality of depth segments using a statistical segmentation model and based on the segmentation parameter data, generate a drilling parameter roadmap based on identifying a segment threshold for each drilling parameter of the reference wellbore data at each of the plurality of depth segments, and generate a report indicating the drilling parameter roadmap for one or more measurement depths of a target wellbore.

The embodiments of the parameter roadmap system have been primarily described with reference to wellbore drilling operations; the parameter roadmap system described herein may be used in applications other than the drilling of a wellbore. In other embodiments, the parameter roadmap system according to the present disclosure may be used outside a wellbore or other downhole environment used for the exploration or production of natural resources. For instance, the parameter roadmap system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. Additionally, as used herein, the term "and/or" includes any and all combinations of one or more of the associated listed items.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for forming a target wellbore, comprising:

deploy a downhole tool into a reference wellbore;

establish a communication link between the downhole tool and a client device;

receiving, via the client device and from the downhole tool, reference wellbore data including drilling parameter data for a plurality of drilling parameters of the reference wellbore;

selecting, via the client device, a segmentation parameter set and associated segmentation parameter data from the reference wellbore data, wherein the segmentation parameter set is a first subset of one or more drilling parameters of the plurality of drilling parameters, and the segmentation parameter data is a subset of the drilling parameter data corresponding to the one or more drilling parameters;

segmenting, via the client device, the reference wellbore data into a plurality of depth segments using a statistical segmentation model and based on the segmentation parameter data;

generating, via the client device, a drilling parameter roadmap based on identifying a segment threshold for each drilling parameter of the reference wellbore data at each of the plurality of depth segments;

providing, to an autonomous drilling system deployed for the target wellbore and via the client device in communication with the autonomous drilling system, the drilling parameter roadmap for forming the target wellbore based on the segment thresholds for each drilling parameter of the plurality of drilling parameters;

drilling the target wellbore via the autonomous drilling system according to the drilling parameter roadmap such that the plurality of drilling parameters does not meet the segment thresholds;

updating, via the autonomous drilling system and according to the drilling parameter roadmap, a second subset of the one or more drilling parameters in real time during the drilling the target wellbore;

updating the drilling parameter roadmap according to the second subset of the one or more drilling parameters to generate an updated drilling parameter roadmap; and continue drilling the target wellbore via the autonomous drilling system according to the updated drilling parameter roadmap.

2. The method of claim 1, wherein the statistical segmentation model utilizes a cost function based on one or more statistical properties of the segmentation parameter data in order to identify change points in the segmentation parameter data.

3. The method of claim 1, wherein the segmentation parameter set includes two or more drilling parameters of the plurality of drilling parameters, and wherein segmenting the reference wellbore data includes performing a multivariate segmentation of the reference wellbore data using the statistical segmentation model based on the two or more drilling parameters of the segmentation parameter set.

4. The method of claim 3, wherein segmenting the reference wellbore data includes normalizing the segmentation parameter data of the two or more drilling parameters of the segmentation parameter set to generate normalized segmentation parameter data, and performing the multivariate segmentation on the normalized segmentation parameter data.

5. The method of claim 3, wherein the segmentation parameter set includes rate of penetration (ROP) and weight on bit (WOB).

6. The method of claim 1, wherein the statistical segmentation model is a segmentation machine learning model that is generated to process source drilling parameter data to determine predicted depth segments having similarities across the source drilling parameter data.

7. The method of claim 6, wherein the segmentation machine learning model utilizes unsupervised segmentation to determine the predicted depth segments.

8. The method of claim 1, wherein the plurality of drilling parameters includes ROP, WOB, RPM, torque, and differential pressure.

9. The method of claim 1, wherein receiving the reference wellbore data includes receiving time-series measurement data and transforming the time-series measurement data to a depth domain.

10. The method of claim 1, wherein receiving the reference wellbore data includes identifying instances of drilling within the reference wellbore data and filtering the reference wellbore data to include only the instances of drilling.

11. The method of claim 1, wherein receiving the reference wellbore data includes identifying a plurality of offset wellbores and associated wellbore data, and selecting, from the plurality of offset wellbores, one or more offset wellbores and the associated wellbore data as the reference wellbore data.

12. The method of claim 11, wherein selecting the reference wellbore data includes selecting the one or more offset wellbores of the plurality of offset wellbores that are closest in proximity to the target wellbore.

13. The method of claim 11, wherein selecting the reference wellbore data includes selecting the one or more offset wellbores of the plurality of offset wellbores that are temporally closest to the target wellbore.

14. The method of claim 11, wherein selecting the reference wellbore data includes selecting the one or more offset wellbores of the plurality of offset wellbores that are most similar to the target wellbore based on contextual data.

15. The method of claim 1, wherein receiving the reference wellbore data includes identifying a plurality of offset wellbores and associated wellbore data, and generating the reference wellbore data based on generating synthetic measurement data from the associated wellbore data of two or more offset wellbores of the plurality of offset wellbores.

16. The method of claim 15, wherein the generating the synthetic measurement data includes selecting, for a measurement depth of the associated wellbore data of the plurality of offset wellbores, measurement data from an offset well having a greatest ROP at the measurement depth.

17. The method of claim 1, further comprising identifying the segment thresholds including identifying, for each depth segment, at least one of an upper limit or a lower limit for target drilling parameters for forming the target wellbore.

18. The method of claim 1, further comprising identifying the segment thresholds including identifying, for each depth segment, one or more statistical limits in the drilling parameter data for each drilling parameter of the reference wellbore data.

19. A system, comprising:

a downhole tool;

an autonomous drilling system;

a controller in electrical communication with the downhole tool and the autonomous drilling system;

at least one processor in electrical communication with the controller;

memory in electronic communication with the at least one processor; and instructions stored in the memory, the instructions being executable by the at least one processor to:

receive reference wellbore data including drilling parameter data for a plurality of drilling parameters of a reference wellbore;

select a segmentation parameter set and associated segmentation parameter data from the reference wellbore data, wherein the segmentation parameter set is a first subset of one or more drilling parameters of the plurality of drilling parameters, and the segmentation parameter data is a subset of the drilling parameter data corresponding to the one or more drilling parameters of the segmentation parameter set;

segment the reference wellbore data into a plurality of depth segments using a statistical segmentation model and based on the segmentation parameter data;

generate a drilling parameter roadmap based on identifying a segment threshold for each drilling parameter of the reference wellbore data at each of the plurality of depth segments;

cause the controller to perform a drilling operation via the autonomous drilling system to form a target wellbore at a measurement depth including adjusting, autonomously and without user input, a target drilling parameter to operate within an associated segment threshold of the drilling parameter roadmap at a depth segment corresponding to the measurement depth;

cause the controller to drill the target wellbore via the autonomous drilling system according to the drilling parameter roadmap such that the target drilling parameter does not meet the associated segment threshold;

update, via the controller and according to the drilling parameter roadmap, the target drilling parameter in real time during the drilling the target wellbore to generate an updated target drilling parameter;

update, via the controller, the drilling parameter roadmap according to the updated target drilling parameter; and cause, via the controller, the autonomous drilling system to continue forming the target wellbore according to the updated drilling parameter roadmap.

20. A non-transitory computer-readable storage medium including instruction that, when executed by at least one processor in electrical communication with a controller, cause the at least one processor to:

receive, via the controller in electrical communication with a downhole tool, reference wellbore data including drilling parameter data for a plurality of drilling parameters of one or more reference wellbores;

select a segmentation parameter set and associated segmentation parameter data from the reference wellbore data, wherein the segmentation parameter set is a first subset of one or more drilling parameters of the plurality of drilling parameters, and the segmentation parameter data is a subset of the drilling parameter data corresponding to the one or more drilling parameters of the segmentation parameter set;

segment the reference wellbore data into a plurality of depth segments using a statistical segmentation model and based on the segmentation parameter data;

generate a drilling parameter roadmap based on identifying a segment threshold for each drilling parameter of the reference wellbore data at each of the plurality of depth segments;

providing, to an autonomous drilling system deployed for a target wellbore and via the controller in communication with the autonomous drilling system, the drilling parameter roadmap for forming the target wellbore based on the segment thresholds for each drilling parameter of the plurality of drilling parameters;

drilling the target wellbore via the autonomous drilling system according to the drilling parameter roadmap such that the plurality of drilling parameters does not meet the segment thresholds;

updating, via the autonomous drilling system and according to the drilling parameter roadmap, a second subset of the one or more drilling parameters in real time during the drilling the target wellbore;

updating the drilling parameter roadmap according to the second subset of the one or more drilling parameters to generate an updated drilling parameter roadmap; and continue drilling the target wellbore via the autonomous drilling system according to the updated drilling parameter roadmap.

* * * * *